US007601024B2

(12) United States Patent
Martich

(10) Patent No.: US 7,601,024 B2
(45) Date of Patent: Oct. 13, 2009

(54) SHIELDED CONNECTOR ASSEMBLY FOR PRETERMINATED SYSTEMS

(75) Inventor: Mark E. Martich, Pawcatuck, CT (US)

(73) Assignee: Ortronics, Inc., New London, CT (US)

( * ) Notice: Subject to any disclaimer, the term of this patent is extended or adjusted under 35 U.S.C. 154(b) by 0 days.

(21) Appl. No.: 11/856,920

(22) Filed: Sep. 18, 2007

(65) Prior Publication Data

US 2008/0280494 A1 Nov. 13, 2008

Related U.S. Application Data

(63) Continuation-in-part of application No. 11/800,587, filed on May 7, 2007.

(51) Int. Cl.
*H01R 13/60* (2006.01)

(52) U.S. Cl. ..... 439/540.1

(58) Field of Classification Search ..... 439/541.5, 439/540.1, 676, 188, 620.05, 620.18
See application file for complete search history.

(56) References Cited

U.S. PATENT DOCUMENTS

| | | | | |
|---|---|---|---|---|
| 6,162,077 | A | 12/2000 | Laes et al. | |
| 6,193,533 | B1 * | 2/2001 | De Win et al. | 439/188 |
| 6,739,892 | B1 * | 5/2004 | Belopolsky et al. | 439/188 |
| 7,014,495 | B2 | 3/2006 | Carroll | |
| 7,017,267 | B2 | 3/2006 | Carroll | |
| 7,033,219 | B2 * | 4/2006 | Gordon et al. | 439/610 |
| 7,048,550 | B2 * | 5/2006 | Hyland et al. | 439/67 |
| 7,163,416 | B2 | 1/2007 | Carroll | |
| 7,229,309 | B2 | 6/2007 | Carroll et al. | |
| 7,335,066 | B2 | 2/2008 | Carroll et al. | |
| 7,367,850 | B1 * | 5/2008 | Chang | 439/676 |

(Continued)

FOREIGN PATENT DOCUMENTS

EP 075510081 B1 5/2002

OTHER PUBLICATIONS

U.S. Appl. No. 11/800,587, filed May 7, 2007.

(Continued)

*Primary Examiner*—Alexander Giman
(74) *Attorney, Agent, or Firm*—McCarter & English, LLP

(57) ABSTRACT

Shielded connector assemblies for use in wiring/cabling applications are disclosed. The connector assemblies include first and second jack openings that facilitate interaction between plugs that feature different contact layouts/alignments, e.g., a first plug that features a conventional CAT 5/CAT 6 contact layout and a second plug that features a contact layout according to the IEC 60603-7-7 standard. Cable/plug combinations are also provided wherein the cable features shielded twisted pair (STP) fully shielded twisted pair (FTP) and unshielded twisted pair (UTP) wires. The cable/plug interface includes a housing wherein individual wires are brought into electrical communication with electrical contacts that are exposed relative to the exterior of the housing. The electrical contacts are positioned in quadrants of the plug housing, when viewed in cross-section, such that the plug complies with the contact geometry set forth in the IEC 60603-7-7 standard. The cable/plug is generally a preterminated assembly, whereby the plug is pre-mounted to the cable before shipment to an installation location or distribution channel. A pulling eye assembly may be provided that defines a cavity sized and configured to receive the plug housing and a portion of the cable.

20 Claims, 13 Drawing Sheets

U.S. PATENT DOCUMENTS

| | | | | |
|---|---|---|---|---|
| 2004/0038594 | A1 * | 2/2004 | Clark et al. | 439/676 |
| 2004/0087217 | A1 * | 5/2004 | Hyland et al. | 439/676 |
| 2008/0007372 | A1 | 1/2008 | Carroll | |

OTHER PUBLICATIONS

U.S. Patent Office Action mailed on Oct. 12, 2007 in U.S. Appl. No. 11/800,587.

Response to Office Action mailed onNov. 20, 2007 in U.S. Appl. No. 11/800,587.

U.S. Patent Office Action mailed on Feb. 5, 2008 in U.S. Appl. No. 11/800,587.

Response to Office Action mailed on Apr. 7, 2008 in U.S. Appl. No. 11/800,587.

U.S. Patent Office Action mailed Jun. 9, 2008 in U.S. Appl. No. 11/800,587.

Petition and Fee For Extension of Time mailed Jul. 9, 2008 in U.S. Appl. No. 11/800,587.

* cited by examiner

SHIELDED CONNECTOR ASSEMBLY FOR PRETERMINATED SYSTEMS

CROSS REFERENCE TO RELATED APPLICATIONS

This application is a continuation-in-part application that claims the benefit of a co-pending, non-provisional patent application: U.S. Ser. No. 11/800,587, entitled "CONNECTOR ASSEMBLY FOR USE WITH PLUGS AND PRETERMINATED CABLES", filed May 7, 2007. The contents of the foregoing application are incorporated herein by reference.

BACKGROUND

1. Technical Field

The present disclosure is directed to connector assemblies for use with electrical wires/cables that include a plug member, particularly preterminated wires/cables. The present disclosure is further directed to connector assemblies and associated plugs that are adapted for delivery of "Category 6A" level performance in an unshielded twisted pair (UTP) environment.

2. Background Art

With the continued evolution of data communication applications, performance standards and requirements continue to advance. The structured cabling industry has experienced a progression from Category 3 level performance standards/requirements, through Category 5/5E, Category 6, and more recently Category 6A performance standards/requirements. At each stage, manufacturers of cabling and connector technologies have been required to address data communication capabilities and limitations of their existing product offerings. Of primary importance in meeting industry requirements is the control/minimization of noise/cross-talk encountered in the connector assemblies. Noise/cross-talk issues become more pronounced as data communication frequencies are increased.

Typical connector assemblies include a jack and a plug that are adapted to detachably engage to effect a data communication connection. Typical RJ-45 connector assemblies include a jack and a plug, each of which includes eight conductors in a predefined side-by-side orientation. Various techniques have been developed to control/address noise and crosstalk that are generated in the jack/plug interface, including capacitive compensation in the jack and/or plug. Noise/crosstalk compensation may be introduced through physical arrangements of the conductors within the jack and/or plug, as well as compensation introduced on printed circuit boards associated with the jack and/or plug.

Alternative conductor layouts for purposes of jack/plug combinations have been proposed. For example, U.S. Pat. No. 6,162,077 to Laes et al. and U.S. Pat. No. 6,193,533 to De Win et al. disclose male/female connector designs wherein shielded wire pairs are arranged with a plurality of side-by-side contacts and additional contact pairs positioned at respective corners of the male/female connector housings. The foregoing arrangement of contacts/contact pairs for shielded cables is embodied in an International Standard—IEC 60603-7-7—the contents of which are hereby incorporated herein by reference. The noted IEC standard applies to high speed communication applications with 8 position, pairs in metal foil (PIMF) shielded, free and fixed connectors, for data transmissions with frequencies up to 600 MHz.

In completing cabling installations, it is generally necessary to feed wiring/cabling from location-to-location, e.g., through conduits and/or in open spaces behind walls, above ceilings and below floors. Frequently, the wire/cable is fed from spools, introduced through the back/side of a wiring box, and terminated by an installation professional, e.g., by punching down individual wires with respect to insulation displacement connectors (IDCs) or the like. According to this conventional installation technique, the installer is able to define the length of each wiring/cabling run at the time of installation, thereby maintaining flexibility. However, the termination process is time-consuming and it is necessary to test/confirm system performance after the installation is complete.

As an alternative installation technique, preterminated wires/cables may be employed to achieve point-to-point wiring connectivity. A preterminated wire/cable generally includes a plug that is pre-mounted with respect to at least one end of a predetermined length of wire/cable. The plug is generally mounted with respect to the wire/cable by the manufacturer and, as part of the manufacturer's quality control procedures, performance at the interface between the wire/cable and the pre-mounted plug is verified before shipment to the installation site. Devices have been developed to encase and protect the pre-mounted plug during the installation process, e.g., as the plug is fed from point-to-point by the installation team. In this way, the potential for damage to the wire/plug connections and associated data communication performance is minimized.

For installations that employ preterminated wires/cables, the necessary wire/cable lengths, types and colors are generally determined before the requisite wiring/cabling is ordered from a manufacturer. Once the length calculations are made, an order is generated specifying the wires/cables that are required for a specific installation (with appropriate margins for error/flexibility), and the manufacturer preassembles terminated cables as specified. The terminated ends, i.e., the pre-mounted plugs, are generally fed into a wiring box and connected to a rearwardly facing jack positioned therewithin to complete a wiring connection. The foregoing jack may be part of a jack assembly that includes oppositely directed jack units, each adapted to receive a plug therewithin. Thus, the rearwardly directed jack generally receives the preassembled plug associated with a preterminated wire/cable, and the forwardly (or outwardly) directed jack generally receives a plug associated with an end user application, e.g., a computer, printer or the like.

Despite efforts to date, a need remains for connector assemblies and techniques that provide enhanced flexibility and/or performance for preterminated wiring/cabling applications. A need also remains for connector assemblies and techniques that facilitate interaction between plugs that feature different contact layouts/alignments. Still further, a need remains for connector assemblies and techniques that facilitate enhanced data communication performance in an environment that includes, in whole or in part, unshielded twisted pair (UTP) wires/cables. These and other needs are satisfied by the connector assemblies and techniques disclosed herein.

SUMMARY

The present disclosure is directed to shielded connector assemblies and techniques for use in preterminated wiring/cabling applications. The disclosed shielded connector assemblies and techniques facilitate interaction between plugs that feature different contact layouts/alignments, e.g., a first plug that features a conventional 8-position RJ-45 contact layout and a second plug that features a contact layout according to the IEC 60603-7-7. The disclosed shielded connector assemblies and techniques support enhanced data communication performance by facilitating interconnection between plugs designed/fabricated according to different contact layout geometries. Stated differently, the disclosed shielded connector assemblies provide compatibility between cabling infrastructure/plugs that feature a conventional RJ-45 contact geometry, and next generation cabling infrastructure/plugs that feature a contact layout according to the IEC 60603-7-7 standard. In this way, optimal data communication performance may be achieved, while maintaining interoperability with the existing RJ-45 cable/plug environment.

The present disclosure is also directed to cable/plug combinations wherein the cable features fully shielded twisted pair (FTP), shielded twisted pair (STP), or unshielded twisted pair (UTP) wires. The cable/plug assembly includes a plug body wherein individual wires are brought into electrical communication with electrical contacts that are exposed relative to the exterior of the plug body. The electrical contacts are positioned in quadrants of the plug body, when viewed in cross-section, such that the plug complies with the contact geometry set forth in the IEC 60603-7-7 standard. The cable/plug assembly is generally a preterminated assembly, whereby the plug is pre-mounted to the cable before shipment to an installation location or distribution channel. A pulling eye assembly may be provided that defines a cavity sized and configured to receive the plug body and a portion of the cable. The pulling eye assembly may include a hinged cover that encases the plug body for pulling of the cable/plug assembly from point-to-point, e.g., through a conduit or an open space in a wall, floor or ceiling.

The disclosed preterminated FTP/STP/UTP cable and plug assembly with IEC 60603-7-7 contact geometry is advantageously adapted to engage and electrically communicate with a shielded jack assembly. The shielded jack assembly may be associated with a connector that includes a pair of jack assemblies, e.g., oppositely directed jacks, whereby cable installation is expedited and facilitated.

Additional features, functions and benefits of the disclosed shielded connectors, cable/plug assemblies and techniques will be apparent from the detailed description which follows, particularly when read in conjunction with the appended figures.

BRIEF DESCRIPTION OF FIGURES

To assist those of skill in the art in making and using the disclosed connectors and plug/cable assemblies, reference is made to the accompanying figures, wherein.

DESCRIPTION OF EXEMPLARY EMBODIMENT(S)

Figure 1:
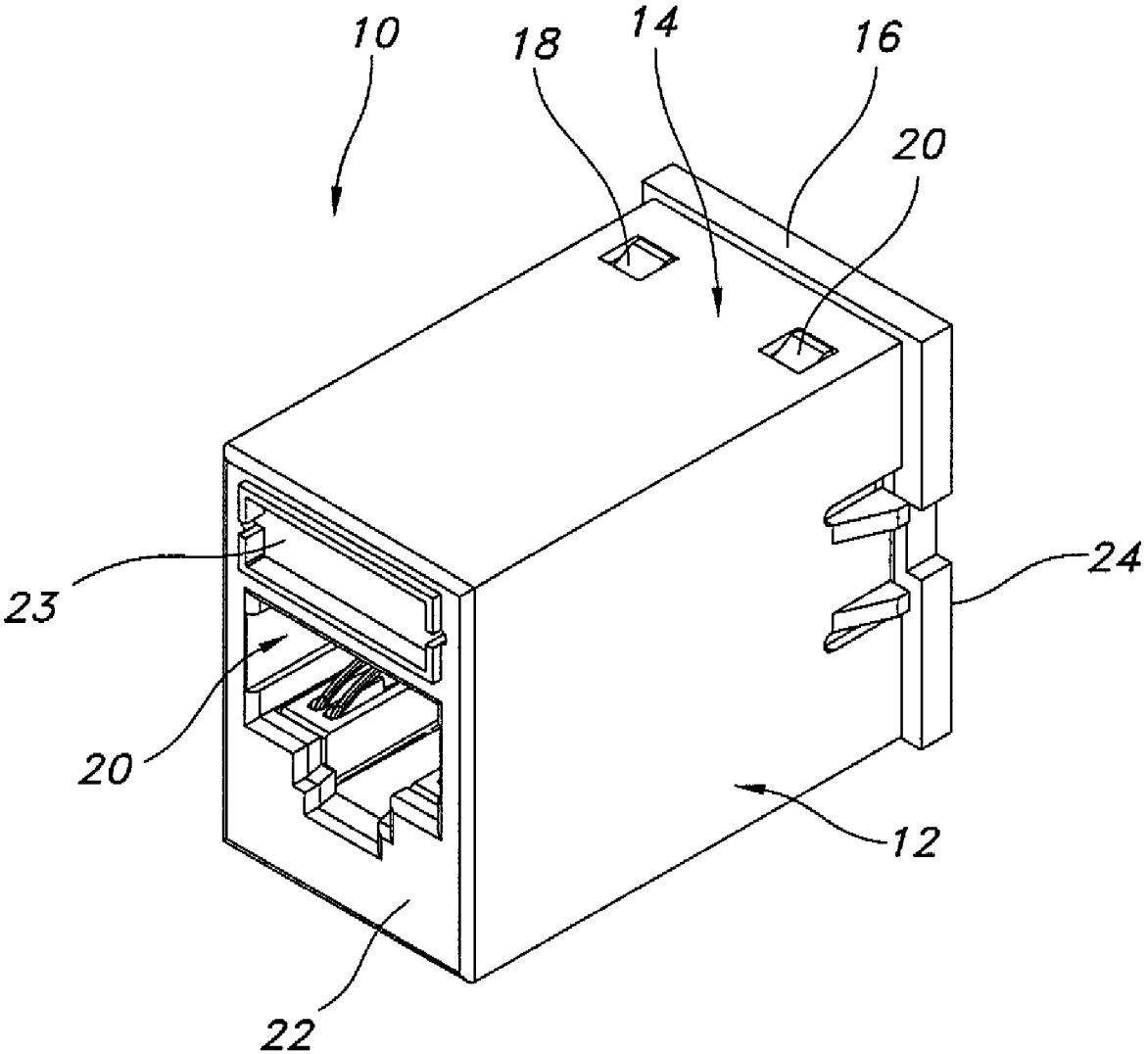
FIG. 1 is a perspective side view of an exemplary connector according to the present disclosure.

Shielded connector assemblies and cabling/wiring techniques are disclosed herein. The disclosed shielded connector assemblies/techniques have particular utility in preterminated wiring/cabling applications, but the disclosure is not limited to such applications and/or implementations. In exemplary embodiments, shielded connector assemblies—including patch panel assemblies that include a plurality of individual shielded connector assemblies—facilitate interaction between plugs that feature different contact layouts/alignments. Thus, in an exemplary implementation, the connector defines a first jack that is configured and dimensioned to electrically cooperate with a first plug featuring a conventional RJ-45 contact layout, and a second jack that is configured and dimensioned to electrically cooperate with a second plug featuring a contact layout consistent with the IEC 60603-7-7 standard.

The disclosed connector assemblies and techniques support enhanced data communication performance by facilitating interconnection between plugs designed/fabricated according to different contact layout geometries. Stated differently, the disclosed connector assemblies provide compatibility between cabling infrastructure/plugs that feature a conventional RJ-45 contact geometry, and next generation cabling infrastructure/plugs that feature a contact layout according to the IEC 60603-7-7 standard. In this way, optimal data communication performance may be achieved, while maintaining interoperability with the existing RJ-45 cable/plug environment. Of note, the disclosed connector assemblies/techniques may be employed to connect FTP/STP cables with UTP cables, FTP/STP cables with FTP/STP cables, or UTP cables with UTP cables. Based on the cabling to be joined to the jacks associated with the disclosed connector assembly, shielding and/or grounding is provided as necessary.

With reference to FIGS. 1-5, connector assemblies 10, 100 and 500 are schematically depicted. Connector assemblies 10, 100 and 500 are structurally and electrically equivalent, except that different latching mechanisms are provided for joining housing elements together, as described in greater detail below. With initial reference to FIG. 1, fully assembled connector assembly 10 includes first housing 12 and second housing 14 that are adapted to latch relative to each other so as to define a unified connector housing unit. In the exemplary embodiment of FIG. 1, first and second deflectable latching members 18, 20 extend from the top surface of first housing 12. Such deflectable latching members 18, 20 detachably engage cooperate slots formed in second housing 14 so as to join first and second housings. Additional latching structures (not shown) may be provided on first and second housings 12, 14, e.g., along bottom surfaces thereof, to further facilitate mounting therebetween. Second housing 14 defines an upstanding ridge 16 that facilitates mounting/positioning of connector assembly 10 relative to a structure or surface, e.g., a wiring box, patch panel or the like.

First housing 12 defines a first jack opening 20 on a face 22 thereof. A label slot 23 is defined above jack opening 20 on face 22. Label slot 23 permits an installer to label the electrical connection associated with connector 10 for future reference. Alternative labeling techniques may be employed, as are known in the art. A second jack opening (not pictured) is formed on a face 24 of second housing 14.

First housing 12 and second housing 14 are typically fabricated from a plastic material, e.g., polycarbonate. Grounding of the first housing 12 and second housing 14 is generally not required because the plug/cable combinations that are mounted to connector 10 feature unshielded twisted pair (UTP) wires. Despite the omission/elimination of shielding from connector assembly 10, advantageous performance levels are achieved through the positioning of contacts/conductors, particularly with respect to the IEC 60603-7-7 contact geometry, and the inclusion of compensation technology, particularly for the conventional RJ-45 contact geometry, as is known in the art.

Figure 2:
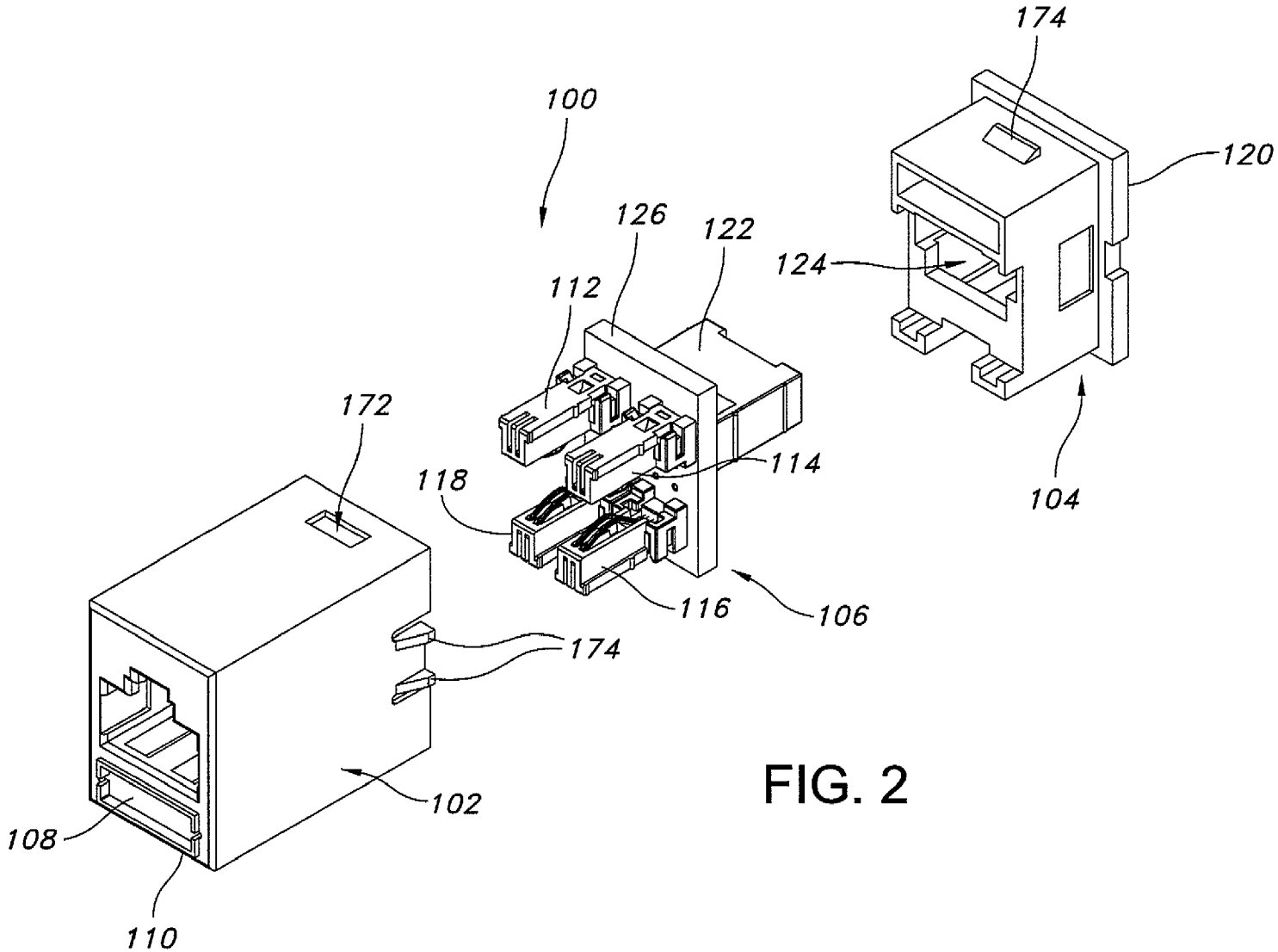
FIG. 2 is an exploded perspective view of an alternative exemplary connector according to the present disclosure.

Turning to FIG. 2, an alternative connector assembly 100 is schematically depicted in an exploded manner. Connector assembly 100 includes first housing 102, second housing 104 and contact subassembly 106. First housing 102 defines a first jack opening 108 in a first face 110 thereof. Contact support members 112, 114, 116 and 118 extend from contact subassembly 106 and define, in part, outer boundaries of jack opening 108. A jack opening (not pictured) in face 120 of second housing 104. A contact insert 122 extends into a rear opening 124 formed in second housing 104 and defines, in part, a boundary of the jack opening formed in second housing 104. A printed circuit board (PCB) 126 is positioned between contact insert 122 and contact support members 112, 114, 116 and 118. PCB 126 includes conventional electronic elements, e.g., traces printed or etched on a non-conductive substrate that facilitate electrical connection across connector 100.

Figure 8:
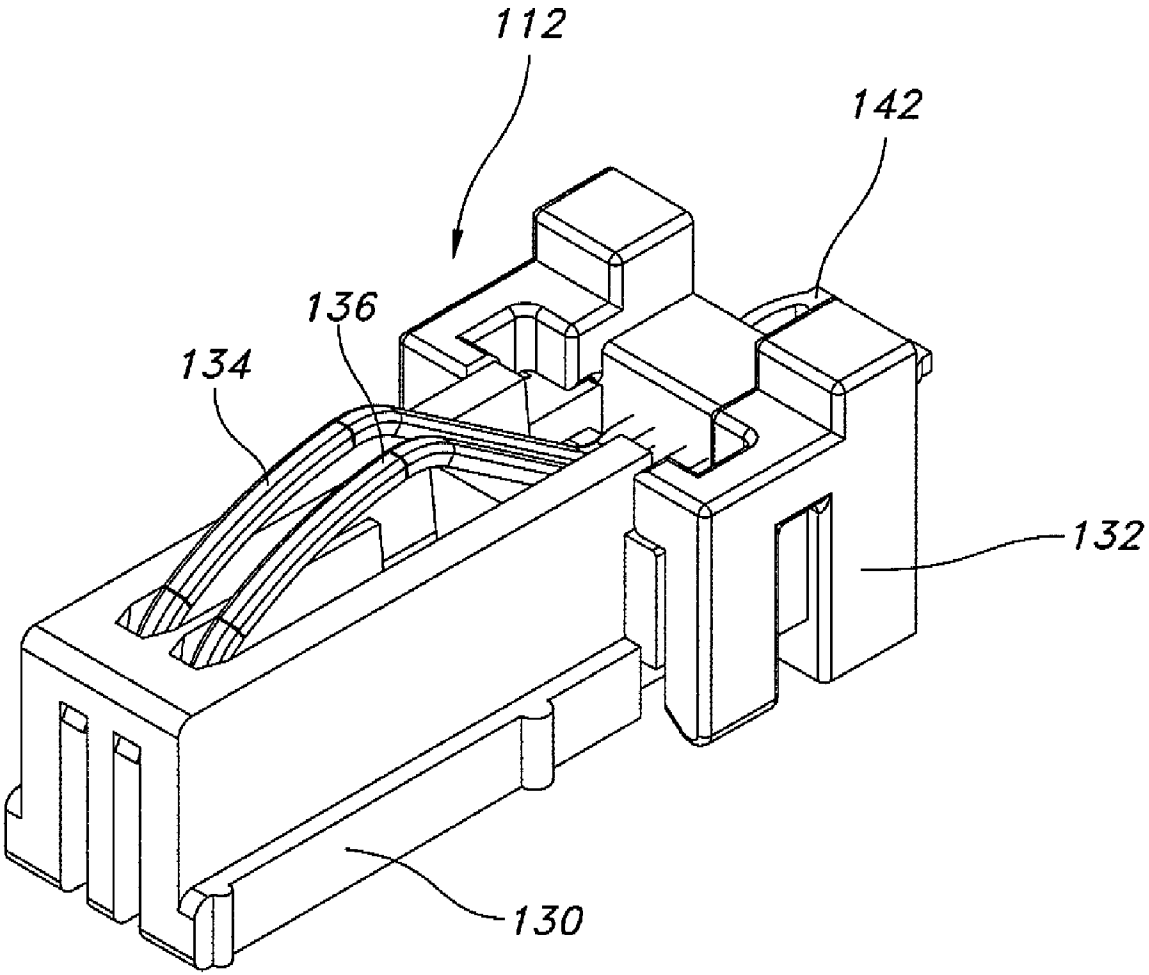
FIG. 8 is a perspective side view of an exemplary contact pair subassembly according to the present disclosure.
Figure 9:
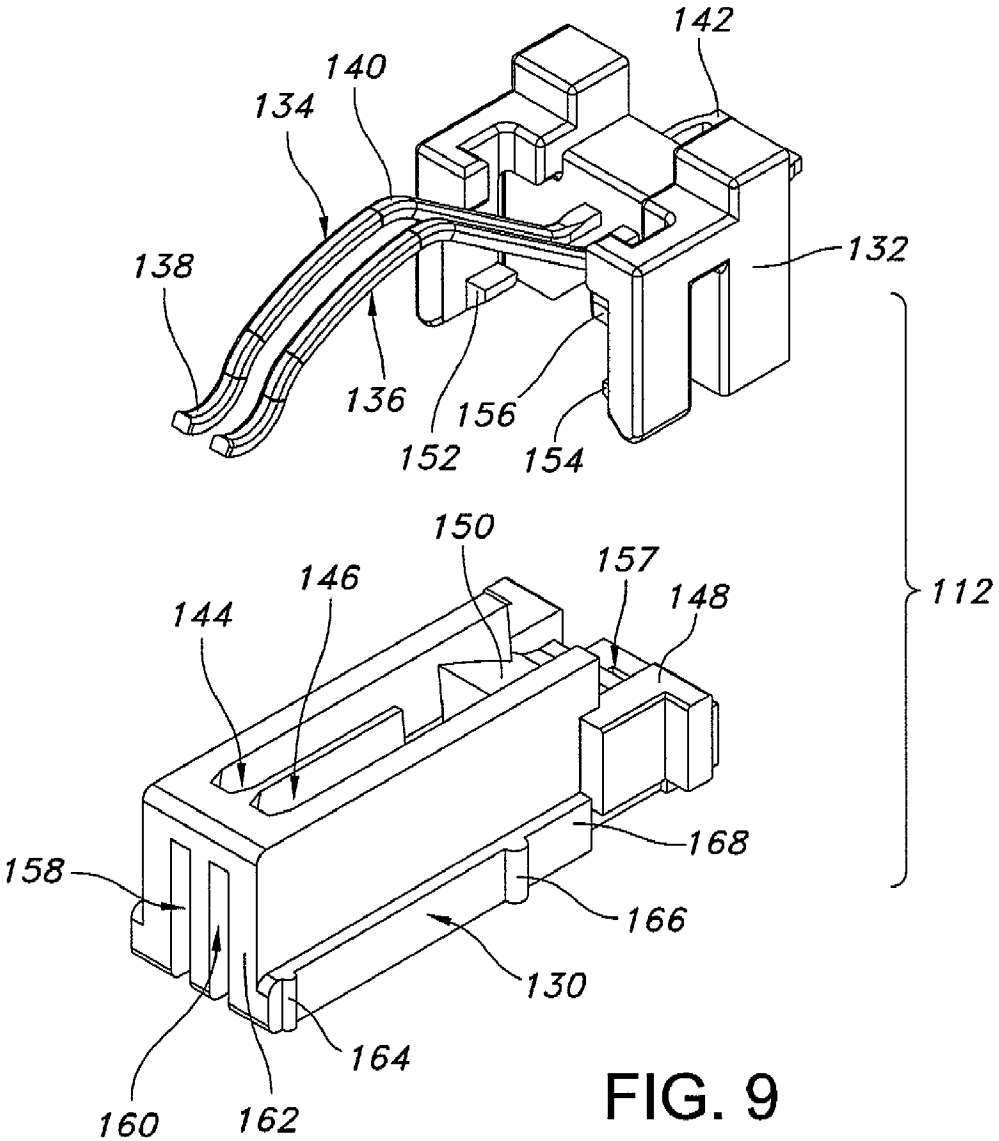
FIG. 9 is an exploded perspective view of the contact pair subassembly of FIG. 8.

With reference to FIGS. 2, 8 and 9, each of contact support members 112, 114, 116 and 118 include two contacts in side-by-side relation. Thus, with particular reference to FIGS. 8 and 9, contact support member 112 is depicted in greater detail. It is to be understood that each of contact support members 112, 114, 116 and 118 may be advantageously configured in like manner, thereby facilitating efficient and cost effective manufacture and inventory practices. Contact support member 112 includes a contact support body 130 and an end cap 132 that support electrical contacts 134, 136 in a side-by-side orientation. Contact members 134, 136 are of substantially identical geometry and include a distal foot 138, an intermediate contact region 140 and a proximal PCB-mounting feature 142. Contact support body 130 defines side-by-side channels 144, 146 that are adapted to receive the distal portion of electrical contacts 134, 136 and support distal foot 138, thereby ensuring that contact region 140 firmly engages a corresponding plug contact when the plug is inserted into jack opening 108 of first housing 102. Thus, each of electrical contacts 134, 136 is deflectable when engaged by a plug, but remains upstanding so as to make effective and reliable electrical contact therewith.

Contact support body 130 further defines an abutment surface 148 that is adapted to cooperate with a cooperating abutment face (not numbered) on end cap 132 to capture electrical contacts 134, 136 therebetween. A ramp 150 is defined on contact support body 130 to support electrical contacts 134, 136 in the region between contact region 140 and PCB-mounting feature 142. End cap 132 defines first and second deflectable latch extensions 152, 154 that facilitate mounting of end cap 132 relative to contact support body 130. End cap 132 also includes a downward extension 156 that is dimensioned for receipt in an aperture 157 formed in contact support body 130 and that functions to space/isolate electrical contacts 134, 136 from each other, thereby ensuring appropriate electrical operation thereof.

Contact support body 130 also generally includes various structural features that facilitate mounting of contact support body with respect to first housing 102. Thus, for example, first and second alignment channels 158, 160 may be provided in a front face of 162 of contact support body 130 for interaction with corresponding features molded onto the inner surface of first housing 102. Similarly, ribs 164, 166 molded on side face 168 of contact support body 130. Ribs 164, 166 may function to space/position contact support body 130 relative to adjacent structures within first housing 102. Additional structural features may incorporated into or onto contact support body 130 (as well as first housing 102) to facilitate relative positioning therebetween, as will be readily apparent to persons skilled in the art. Thus, the present disclosure is not limited to or by the exemplary positioning features/elements disclosed herein, but extends to and encompasses alternative positioning features/elements as would be readily apparent to persons skilled in the art.

Returning to FIG. 2, contact support members 112, 114, 116 and 118 are mounted with respect to PCB 126 through interaction between PCB-mounting features 142 formed at the proximal end of electrical contacts 142, and corresponding mounting apertures/through holes formed on PCB 126. Thus, in the exemplary embodiment of FIGS. 8 and 9, PCB-mounting feature 142 includes a deflectable eyelet that is adapted to be inserted into a corresponding aperture/through hole formed in PCB 126 to secure the electrical contact with respect to PCB 126. Securement therebetween may be further ensured through a welding, soldering, or other conductively adhesive operation, as is known to persons skilled in the art. Additional mounting features and/or structures may be associated with end cap 132 and/or PCB 126 to further enhance the mounting interaction therebetween, e.g., an adhesive, as will be readily apparent to persons skilled in the art.

Figure 11:
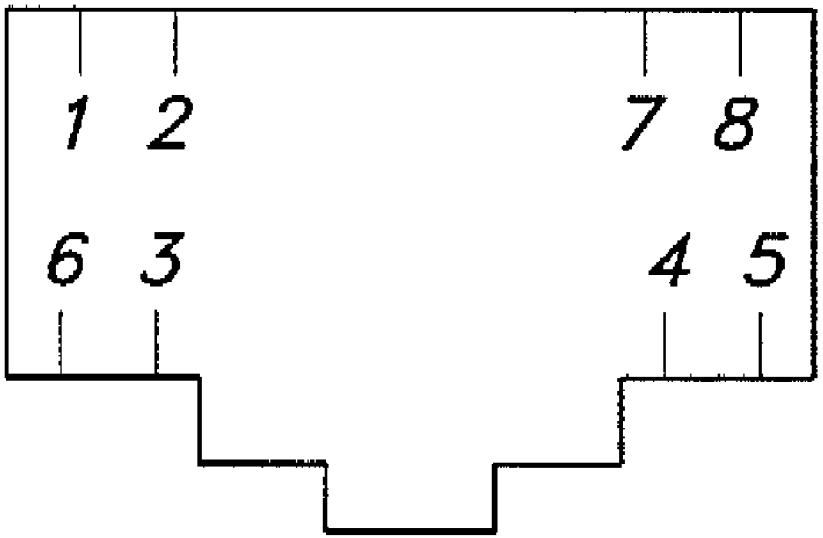
FIG. 11 is a front schematic view of a contact alignment for an exemplary jack according to the present disclosure.

Contact support members 112, 114, 116 and 118 extend in a substantially cantilever fashion from PCB 126 and are spaced relative to each other so as to define a desired contact geometry for interaction with a cooperative plug member. With reference to FIG. 11, the contact alignment within exemplary jack opening 108 is schematically depicted. Thus, the pair of electrical contacts associated with contact support member 112 correspond to wire pair 1/2, the pair of electrical contacts associated with contact support member 114 correspond to wire pair 7/8, the pair of electrical contacts associated with contact support member 116 correspond to wire pair 4/5, and the pair of electrical contacts associated with contact support member 118 correspond to wire pair 3/6. Due to the pairing and spacing of electrical contacts within jack housing 108 (and the corresponding contact pairing and spacing of the jack to be inserted therein), crosstalk/noise is substantially reduced or eliminated with respect to the interaction between electrical contacts associated with contact support members 112, 114, 116 and 118, and the corresponding contacts associated with a plug to be inserted therein.

Figure 6:
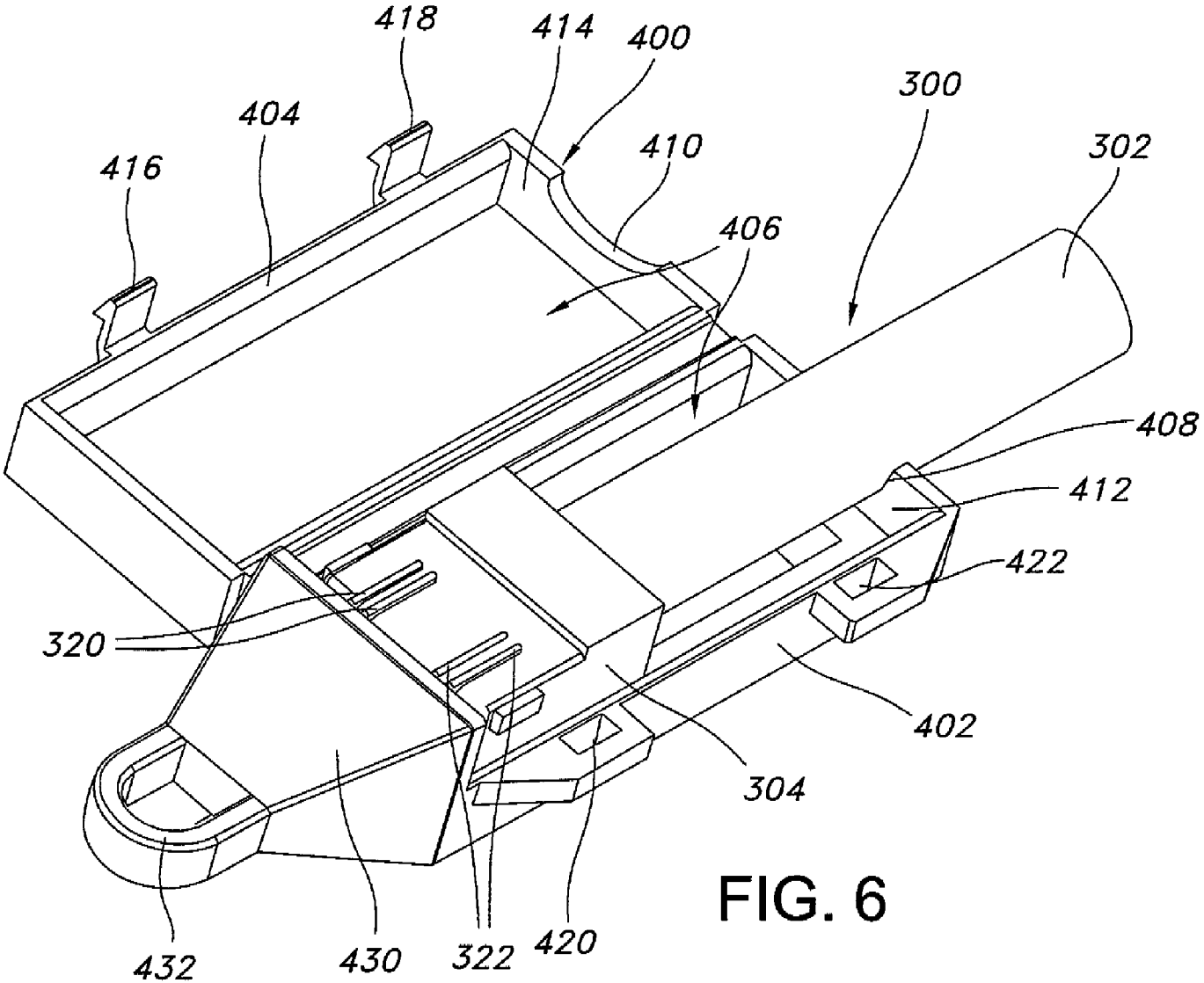
FIG. 6 is a perspective side view of a plug/cable assembly positioned within a pulling eye assembly according to an exemplary embodiment of the present disclosure.
Figure 7:
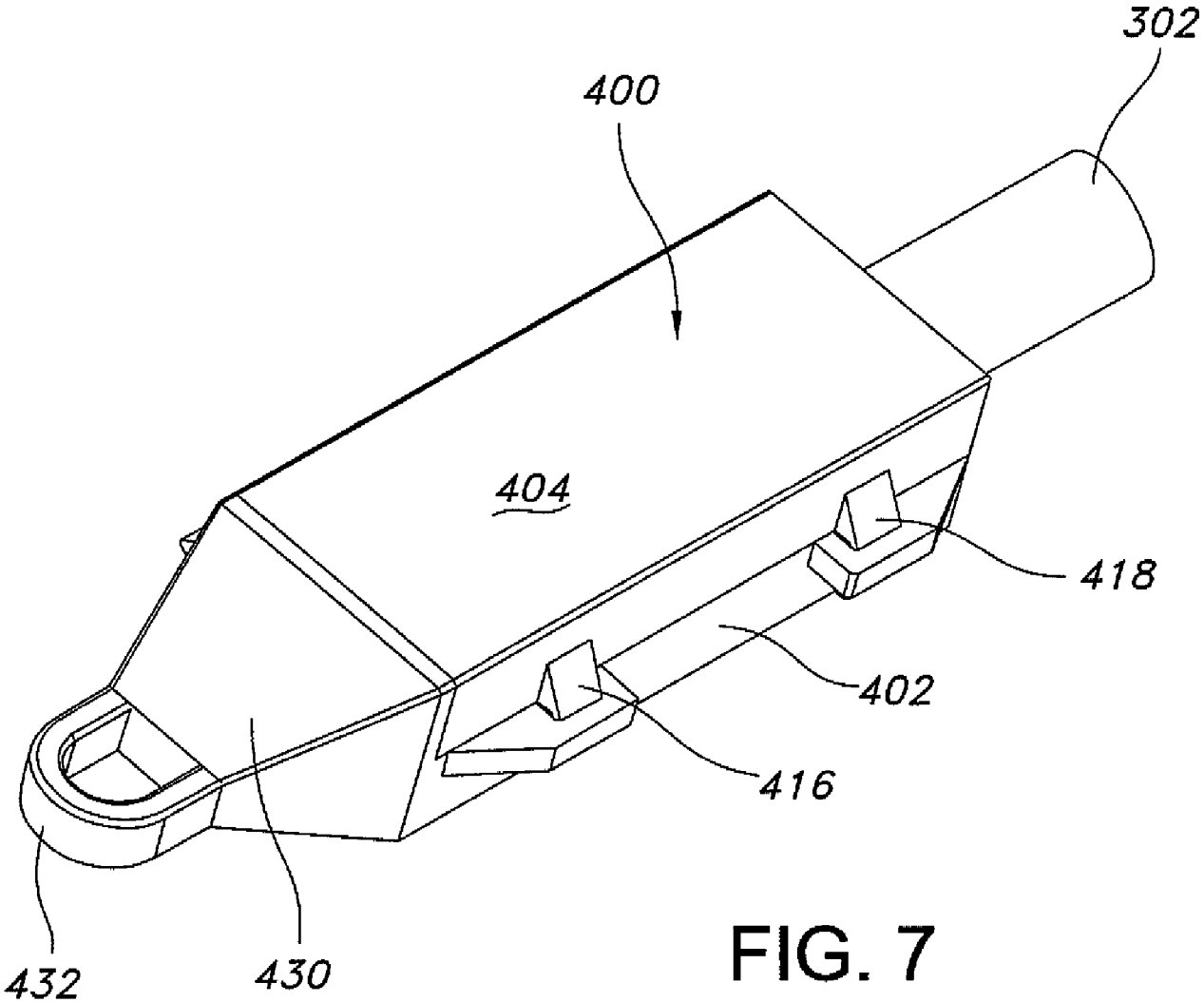
FIG. 7 is a perspective side view of the plug/cable assembly of FIG. 6 with the pulling eye assembly rotated into its closed position.

Turning to FIGS. 6 and 7, an exemplary cable/plug assembly 300 for use in combination with jack opening 108 of connector assembly 100 is schematically depicted. Cable/plug assembly 300 includes a cable 302 and a plug 304 fixedly mounted with respect thereto. As depicted in FIGS. 6 and 7, cable/plug assembly 300 constitutes a preterminated assembly, i.e., an cable/plug assembly that is constructed by a manufacturer prior to shipment to an installation site and/or distribution channel. The length of cable 302 is generally defined for a particular installation based on the installer's determination of the requisite cable run. For example, the installer may determine that a plug/cable assembly of 100' length is required to extend from point A to point B. The installer would communicate this need to a manufacturer of preterminated plug/cable assemblies (generally, as part of a larger order that includes a plurality of plug/cable assembly requirements of differing cable lengths), who would fabricate the plug/cable assembly to the installer's specification(s).

At the installation site, plug 304 associated with plug/cable assembly 300 is advantageously delivered to a desired location through a conduit and/or through open space behind a wall, below a floor or above a ceiling. To facilitate such delivery, a removable delivery structure 400 may be provided to protect the plug/cable interface during the cable installation process. Exemplary delivery structure 400 takes the form of a pulling eye assembly that includes a base 402 and a hinged cover 404. The base 402 and cover 404 together define a cavity 406 that is dimensioned and configured to receive plug 304 and a portion of cable 302. Substantially semi-circular openings 408, 410 are defined in rear faces 412, 414 of base 402 and cover 404, respectively. The semi-circular openings 408, 410 cooperate to define a substantially circular opening that is dimensioned to receive and surround cable 302. A pair of spaced, deflectable latch members 416, 418 are defined on hinged cover 404 for detachable engagement with latching slots 420, 422 formed with respect to base 402.

To facilitate delivery of plug/cable assembly 300 to a desired location, base 402 further defines a substantially pyramidal front extension 430 that defines a pulling eye 432 at a front face thereof. The inclined surfaces of pyramidal front extension 430 facilitate routing of plug/cable assembly 300 to a desired location. Similarly, pulling eye 432 is configured and dimensioned to cooperate with a detachable pulling member, e.g., a cable, wire or the like, that may be used to pull plug/cable assembly 300 and delivery structure 400 to a desired location. By limiting the pulling force associated with routing of plug/cable assembly 300 to delivery structure 400, potential damage to the interface between plug 304 and cable 302 is minimized and/or eliminated. Once the plug/cable assembly 300 reaches a desired location, latch members 416, 418 are detached from the cooperative latching slots 420, 422 and hinged cover 404 is rotated/pivoted to its open position (e.g., the position shown in FIG. 6). The plug/cable assembly 300 is then removed from delivery structure 400 and the delivery structure discarded or retained for potential reuse.

With further reference to FIG. 6, it is noted that plug 304 includes two pairs of exposed contacts on an upper face thereof. As is apparent from the exemplary contact geometry depicted in FIG. 11, contact pair 322 may correspond to wire pair 1/2 or wire pair 4/5, while contact pair 320 may correspond to wire pair 7/8 or wire pair 3/6, depending on which face of plug 304 is upwardly directed in delivery structure 400. When inserted within jack opening 108 of connector assembly 100, contact pairs 320, 322 make electrical contact with corresponding contact pairs on contact support members 112, 114, or contact support members 116, 118. Additional contact pairs (not visible) are positioned on the opposite side of plug 300 and are adapted to engage corresponding contacts associated with contact support members 112, 114 or contact support members 116, 118, as the case may be.

Of particular note, the plug/cable assembly 300 of the present disclosure is advantageously formed with respect to a cable 302 that includes unshielded twisted pair (UTP) wires. Thus, within plug 304, UTP wires are brought into electrical contact with appropriate contact pairs defined by plug 304. UTP wire pairs 1/2 are advantageously brought into electrical contact with contacts 322, while wire pairs 7/8 are advantageously brought into electrical contact with contacts 320. Similar electrical connections are achieved with respect to the other UTP wires and contacts associated with plug 304. Inasmuch as cables that feature UTP wiring are employed according to the present disclosure, shielding issues associated with the plug/jack interface are eliminated.

Returning to FIG. 2, connector assembly 100 includes a latching slot 170 defined in first housing 102 that is adapted to engage upstanding latch 172 defined on second housing 104. Additional latching structures, e.g., latch members 174, may be provided to ensure secure mounting of first and second housings 102, 104 and/or mounting of connector assembly 100 relative to ancillary housings and/or support structures (not pictured).

When fully assembled, connector assembly 100 defines oppositely directed first and second jack openings. Thus, with reference to FIGS. 4 and 5, first jack opening 108 and second jack opening 180 are oppositely directed with respect to the longitudinal axis of the connector assembly 100. Contacts 184 extend from contact insert 122 into second jack opening 180 are adapted to interact with a conventional RJ-45 plug. Thus, contacts 184 are in side-by-side orientation, as is well known to persons skilled in the art. To address noise/crosstalk associated with the interaction of contacts 184 and a conventional RJ-45 plug, PCB 126 generally includes compensation functionality that is designed to offset/compensate for such noise/crosstalk. The design and operation of PCB-based compensation, particularly in an RJ-45 environment, is well known to persons skilled in the art. Of note, connector assembly 100 may include a labeling position 182 on a face 110 of first housing 102, such labeling position 182 permitting an installer to label the connection port associated with connector assembly 100.

Figure 5:
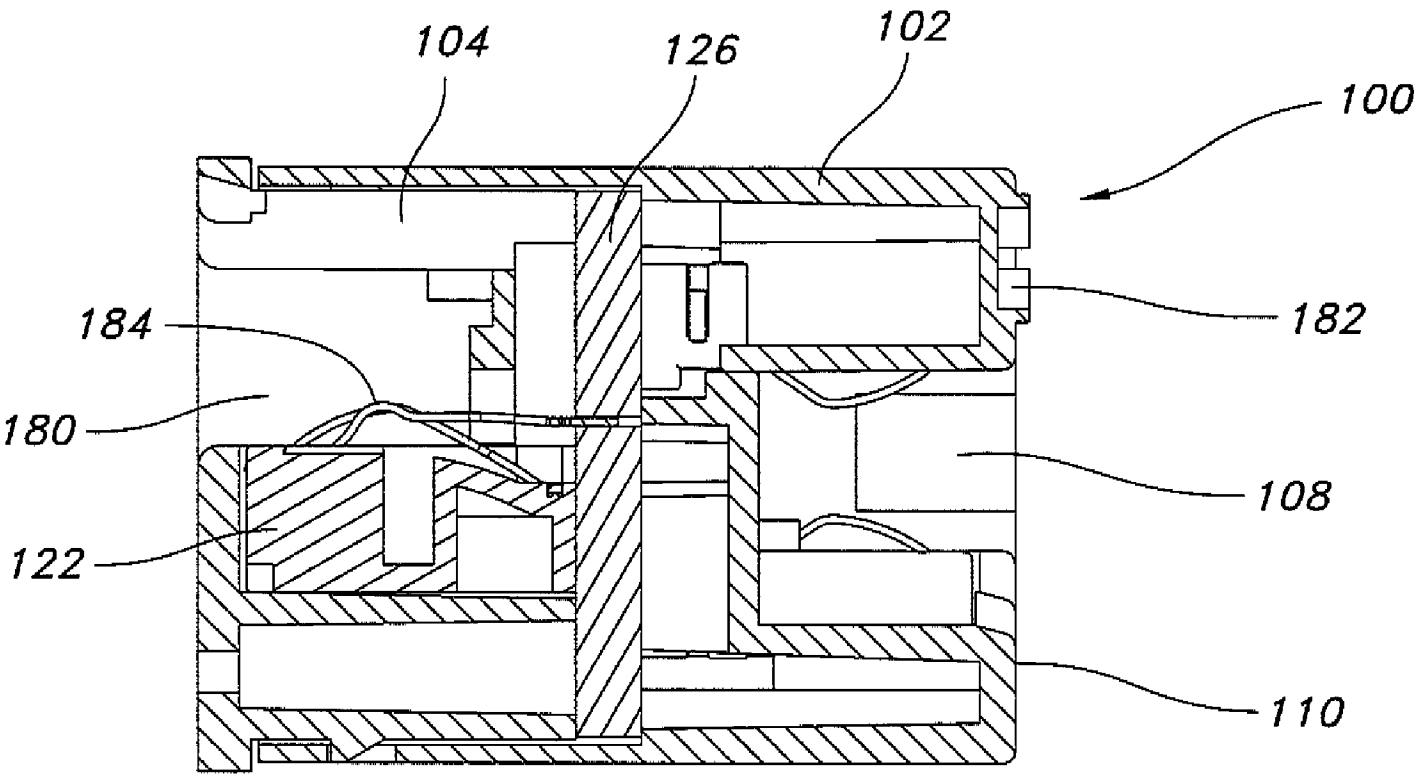
FIG. 5 is a cross-sectional view of the exemplary connector of FIG. 4, taken along line A-A therein.

In use and with particular reference to the cross-sectional view of FIG. 5, connector assembly 100 is effective to provide an electrical connection between a first plug/cable that includes contacts geometrically arranged according to the IEC 60603-7-7 standard, i.e., by inserting such first plug in first jack opening 108, and a second plug/cable that includes contacts geometrically arranged according to a conventional RJ-45 contact alignment, i.e., by inserting such second plug in second jack 180. The first plug/cable are advantageously preterminated by the manufacturer and preferably feature UTP wiring (although the present disclosure may also be employed with FTP/STP wiring), thereby permitting an installer to feed the preterminated first plug (e.g., exemplary plug 304 of FIG. 6) into first jack opening 108 at an installation site. Indeed, in a preferred implementation of the present disclosure, connector 100 is positioned in a wiring box (e.g., in conjunction with appropriate housing structure(s)), and the preterminated plug 304 is introduced to jack opening 108 within such wiring box (e.g., a single gang box) as part of the installation process and without the need to punch down wires, test wiring performance, etc.

A second plug (not pictured) may be inserted into second jack opening, e.g., by an end-user, to complete an electrical circuit. Thus, the second jack opening may receive an RJ-45 plug associated with a computer, laptop, printer or other component. Compensation is introduced to such electrical circuit, e.g., by PCB 126, to compensate for the noise/crosstalk associated with the RJ-45 connection afforded by second jack opening 180.

Connector 100 offers superior electrical performance, accommodates the in situ combination of RJ-45 and IEC 60603-7-7 technologies, and facilitates the use/implementation of preterminated jack assemblies, e.g., in a FTP/STP and/or UTP environment. Compensation is provided, as necessary, to address noise/crosstalk associated with the RJ-45 aspect of the connector assembly, while compensation is unnecessary with respect to the IEC 60603-7-7 aspect of the connector assembly. Similarly, the implementation and use of UTP wiring obviates the need for shielding structures and/or functionalities with respect to the IEC 60603-7-7 aspect of the connector assembly.

Figure 3:
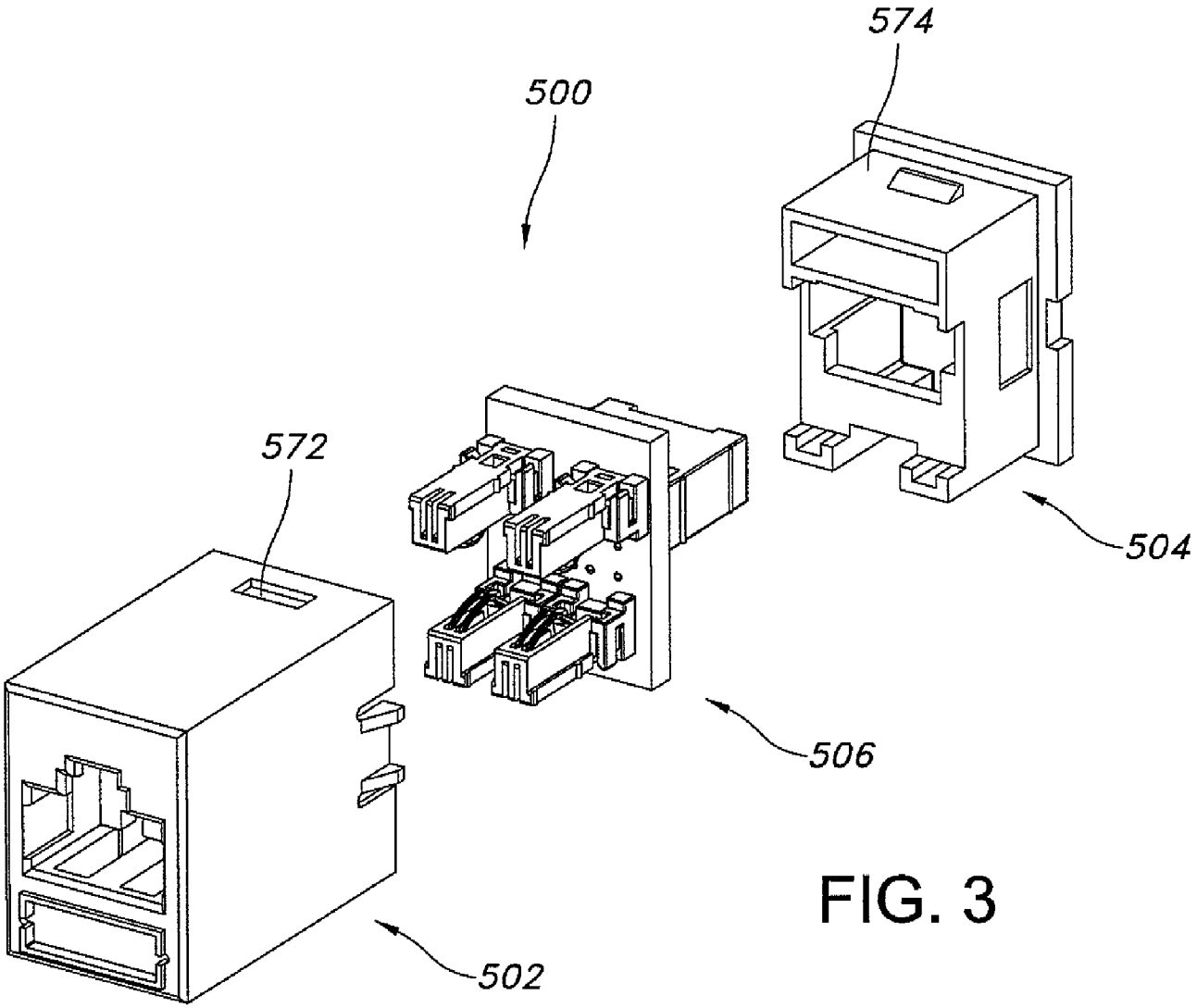
FIG. 3 is an exploded perspective view of a further alternative exemplary connector according to the present disclosure.
Figure 4:
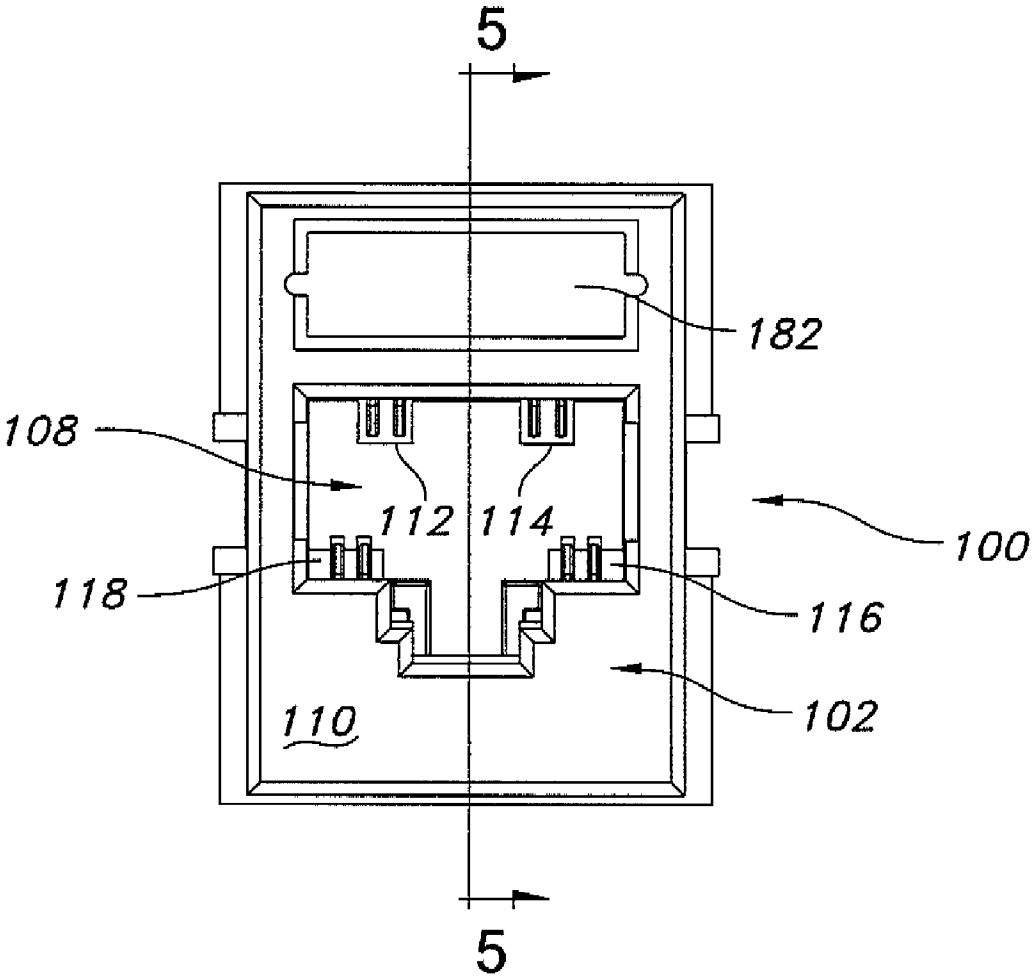
FIG. 4 is a front view of an exemplary connector according to the present disclosure.

Turning to FIG. 3, an alternative connector assembly 500 is schematically depicted according to the present disclosure. Like connector assemblies 10 and 100 described herein, connector assembly 500 includes a first housing 502, a second housing 504 and a contact subassembly 506. The individual components and functions of connector assembly 500 are equivalent to those described with reference to connector assembly 200, except that the latching of first housing 502 with respect to second housing 504 is achieved with a centrally located deflectable latching member 572 formed on first housing 502 that is adapted to engage a latching slot 574 formed on second housing 504. The design, operation and functional/structural advantages of connector assembly 500 correspond to those described herein with respect to connector assemblies 10 and 100.

Figure 10:
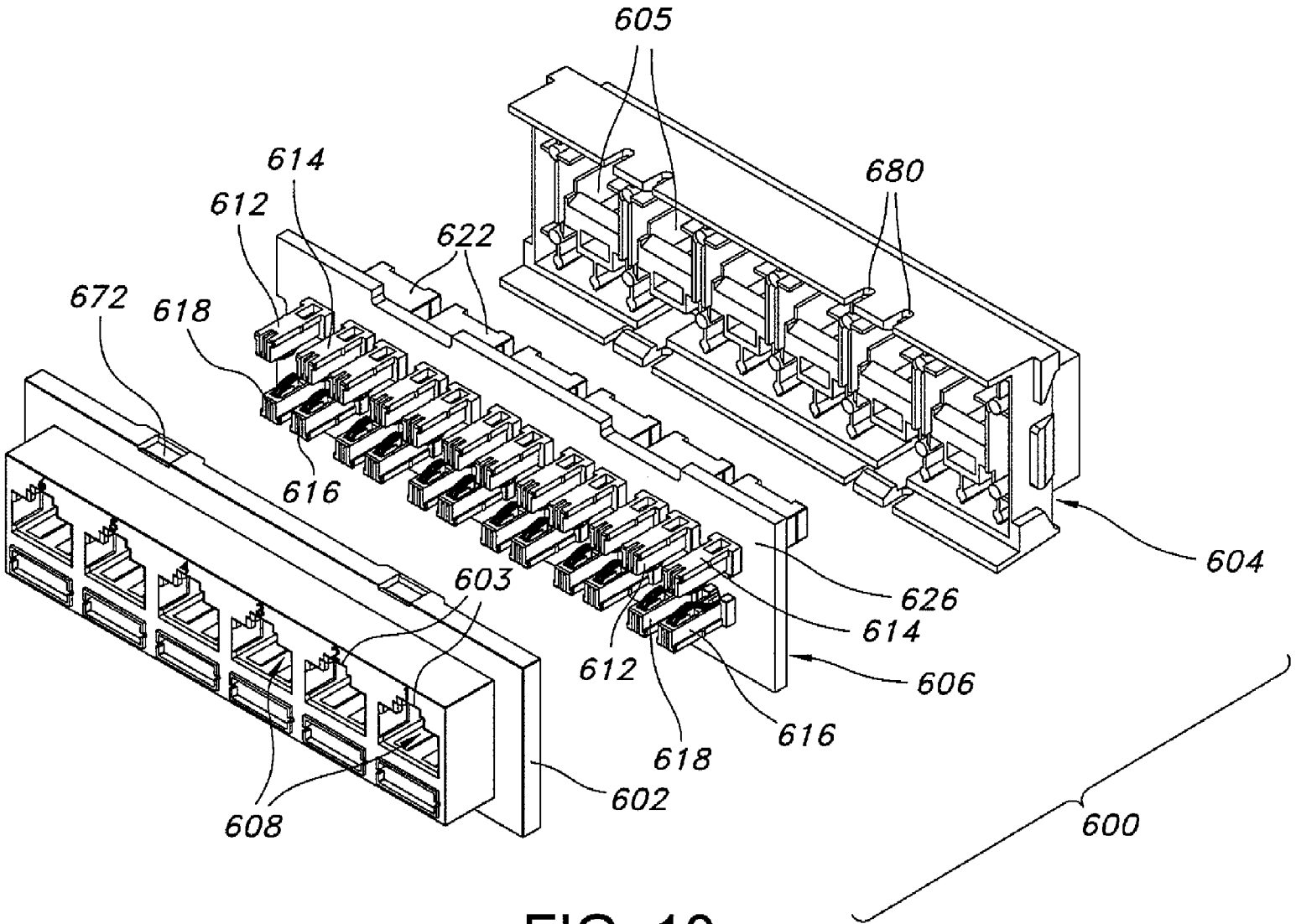
FIG. 10 is an exploded patch panel assembly that includes six (6) connectors according to the present disclosure.

Turning to FIG. 10, a further advantageous implementation of the present disclosure is schematically depicted. Patch panel assembly 600 includes a first housing 602 that includes a plurality (6) ports 603 in side-by-side alignment. Each port 603 defines a first jack opening 608 for receipt of a plug. A second housing 604 includes a corresponding plurality (6) of ports 605 in side-by-side alignment, each port 605 defining a second jack opening 680. A contact subassembly 606 includes a plurality (6) of contact inserts 622 for introduction into jack openings 680. Contact inserts 622 are mounted with respect to a PCB 626, as are sets (6) of contact support members 612, 614, 616, 618. Latching structures 672 are provided on first housing 602 to facilitate mounting of first housing 602 with respect to second housing 604 (with contact subassembly 606 positioned therewithin or therebetween.

As will be readily apparent to persons skilled in the art, patch panel assembly 600 extends the electrical connection technology described herein above with reference to connector assemblies 10, 100, 500 to a patch panel environment. Thus, each of the port combinations 603, 605 functions as an individual connector assembly, in the sense of connector assemblies 10, 100, 500 described herein above. Each of ports 603 is adapted to receive/cooperate with a contact alignment according to the IEC 60603-7-7 standard, whereas each of ports 605 is adapted to receive/cooperate with a conventional RJ-45 contact alignment. Patch panel assembly extends the structural and functional advantages of the disclosed connector assemblies 10, 100, 500 to a multi-port application. Alternative patch panel designs and geometries, e.g., 12 port, 24 port, angled and/or arcuate patch panel assemblies, and the like, may benefit from the disclosed connector assembly technology. Further, preterminated plug/cable assemblies may be used in cooperation with the disclosed patch panel assembly 600 (and alternative multi-port assemblies) to achieve the benefits associated therewith.

Figure 12:
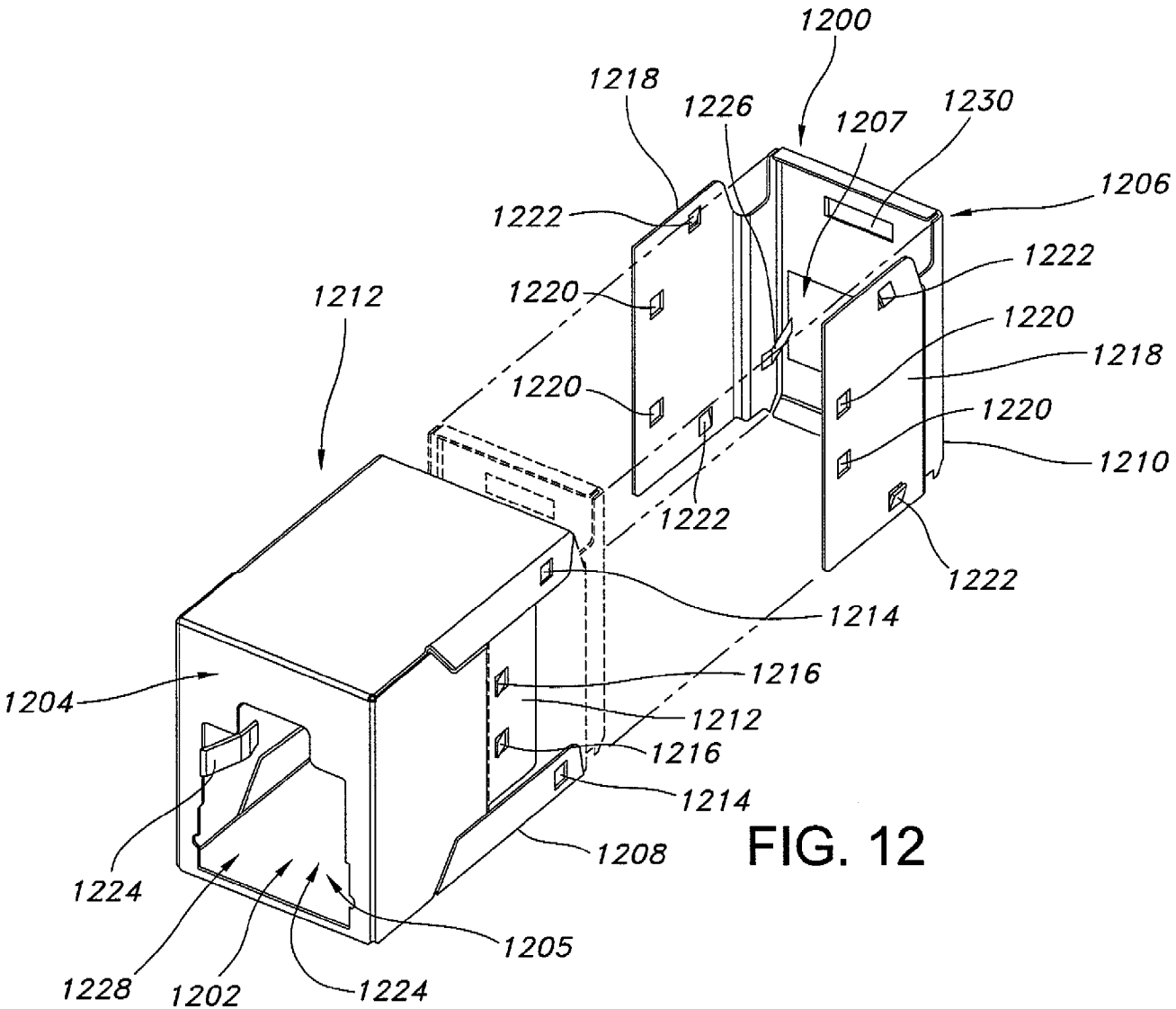
FIG. 12 is an exploded assembly comprising an exemplary shield for a connector in accordance with the present disclosure.

Turning now to FIG. 12, a shield 1200 is depicted in accordance with embodiments of the present disclosure. The shield 1200 defines a cavity 1202 sized and shaped and otherwise configured to receive and/or surround a connector assembly, e.g., one or more of the connector assembly 10 shown and described above with respect to FIG. 1, the connector assembly 100 shown and described above with respect to FIG. 2, and/or the connector assembly 500 shown and described above with respect to FIG. 3. The shield 1200 includes a first end 1204 at which is formed a first aperture 1205 for receiving a plug connector, and a second end 1206 at which is formed a second aperture 1207 for receiving a plug connector. The shield 1200 is further formed from one or more suitable materials, (e.g., one or more suitable electrically conductive and/or metallic materials, such as a copper based brass material, a metal-plated material, a die-cast material) adapted to shield a connector assembly contained within cavity 1202 of the shield 1200 between the first and second ends 1204, 1206 thereof from electrical noise and/or other effects from electromagnetic interference (EMI), and/or to provide ground continuity (e.g., with respect to associated preterminated cable/plug assemblies). For example, in accordance with embodiments of the present disclosure, a connector assembly (not specifically shown) may be contained and/or enclosed within the cavity 1202 defined by the shield 1200, a first preterminated cable/plug assembly (not specifically shown) may be inserted through the first aperture 1205 for electrically and physically coupling to such connector assembly, and a second preterminated cable/plug assembly (not specifically shown) may be inserted through the second aperture 1207 for electrically and physically coupling with such connector assembly, and/or for forming associated electrical connections with the respective first preterminated cable/plug assembly via such connector assembly. In such circumstances, the shield 1200 may function both to limit or reduce/suppress electrical noise such as might otherwise arise within such connector assembly (not specifically shown) as a result of electromagnetic interference, and to establish ground continuity between the first and second preterminated cable plug assemblies. For example, the shield 1200 may function to form separate electrical connections with respective external shielding structures formed on or associated with opposing respective plug housings of the first and second preterminated cable/plug assemblies, and/or with respective elongate axial shielding structures enclosing or associated with respective cable lengths thereof.

Still referring to FIG. 12, the shield 1200 may include a first housing portion 1208 associated with the first end 1204 and a second housing portion 1210 associated with the second end 1206, wherein the first and second housing portions 1208, 1210 are adapted to be coupled together in an assembly to define the cavity 1202. In this regard, the first housing portion 1208 includes a pair of side panels 1212, a pair of slots 1214 formed in each such side panel 1212, and a pair of upstanding latches 1216 provided on each such side panel, and the second housing portion 1210 includes a pair of side panels 1218 sized and shaped for functional interoperation with the side panels 1212 of the pair thereof, a pair of slots 1220 sized and shaped for functional interoperation with the latches 1216 of the pair thereof, and a pair of upstanding latches 1222 sized and shaped for functional interoperation with the slots 1214 of the pair thereof, all cooperatively positioned for securely physically and electrically coupling the first and second housing portions 1208, 1210 together, defining an advantageous overall geometry for the cavity 1202, and establishing and maintaining electrical continuity as between the first and second ends 1204, 1206.

The first housing portion 1208 further includes a pair of grounding tabs 1224, each grounding tab 1224 of such pair being disposed at the first end 1204 along a respectively opposite side of the first aperture 1205. The second housing portion 1210 further includes a pair of grounding tabs 1226, each grounding tab 1226 of such pair being disposed at the second end 1206 along a respectively opposite side of the second aperture 1207. The structure and function of the grounding tabs 1224, 1226 will be described more fully below.

The first housing portion 1208 further includes a label slot 1228 disposed at the first end 1204. The second housing portion further includes a label slot 1230 disposed at the second end 1206. The structure and function of the label slots 1228, 1230 will be described more fully below.

Referring now to FIGS. 13, 14, 15 and 16, in accordance with embodiments of the present disclosure, a shielded jack 1300 is shown. The shielded jack 1300 includes the shield 1200, and a connector assembly 1302 enclosed within the shield 1200. As described above, the connector assembly 1302 may be an implementation of any one or more of: (1) the connector assembly 10 shown and described above with respect to FIG. 1, (2) the connector assembly 100 shown and described above with respect to FIG. 2, (3) the connector assembly 500 shown and described above with respect to FIG. 3, and/or (4) a connector assembly in accordance with embodiments of the present disclosure other than the connector assemblies 10, 100 and 500. For example, the connector assembly 1302 may be an implementation of the connector assembly 100 shown and described above with respect to FIG. 2, wherein a first face 1304 and a first jack opening 1306 formed therein is aligned with the first end of the shield 1200, and a second face 1308 and a second jack opening 1310 formed therein is aligned with the second end of the shield 1200.

Figure 14:
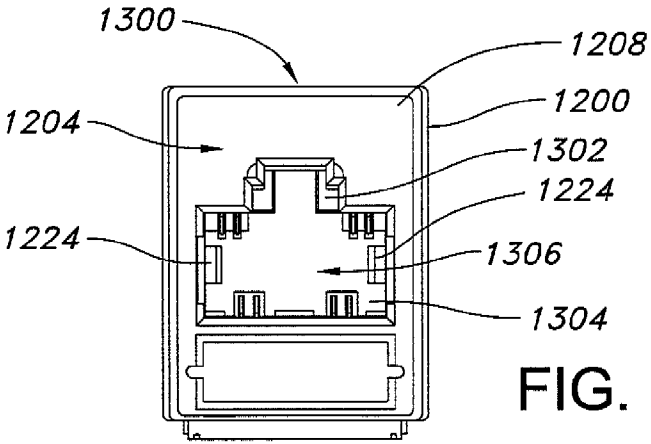
FIG. 14 is an elevational view of a first end of the shielded jack of FIG. 13.
Figure 16:
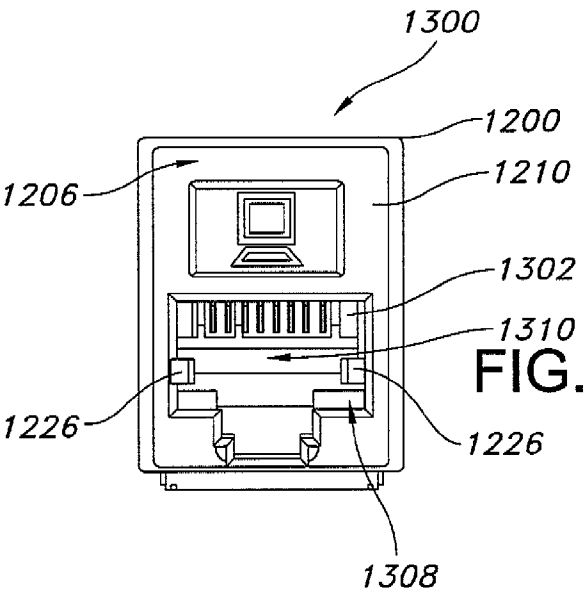
FIG. 16 is an elevational view of an opposite second end of the shielded jack of FIG. 13.
Figure 13:
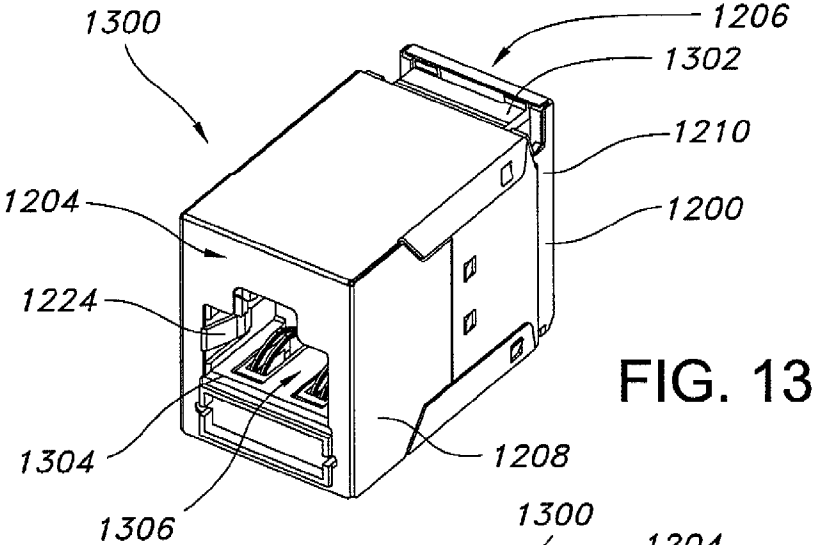
FIGS. 13 is a perspective side view of an exemplary shielded jack in accordance with the present disclosure.
Figure 15:
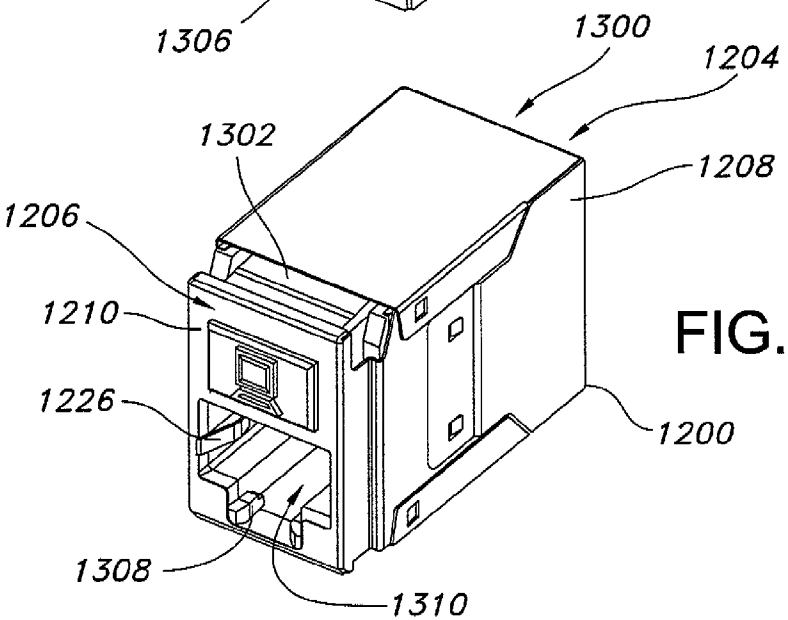
FIG. 15 is another perspective side view of the shielded jack of FIG. 13.

As shown in FIGS. 13 and 14, the grounding tabs 1224 of the first housing portion 1208 extend to within a projected outline of the first jack opening 1306, such that upon a plug portion of a preterminated cable/plug assembly (not shown) being coupled to the connector assembly 1302 at the first jack opening 1306, the grounding tabs 1224 are appropriately positioned to deflectably interact with corresponding shielding structure associated with the cable/plug assembly for purposes of establishing a grounding connection therewith. As shown in FIGS. 15 and 16, the grounding tabs 1226 of the second housing portion 1210 extend to within a projected outline of the second jack opening 1310, such that upon a plug portion of a preterminated cable/plug assembly being coupled to the connector assembly 1302 at the second jack opening 1310, the grounding tabs 1226 are appropriately positioned to deflectably interact with corresponding shielding structure associated with the cable/plug assembly for purposes of establishing a grounding connection therewith.

As shown in FIGS. 13 and 14, the shielded jack 1300 further includes a label 1312, wherein the label 1312 is mounted with respect to the first housing portion 1208 at the first end 1204 of the shield 1200 via a fastening arrangement involving the label slot 1228 (FIG. 12). As shown in FIGS. 15 and 16, the shielded jack 1300 further includes a label 1314, wherein the label 1314 is mounted with respect to the second housing portion 1210 at the second end 1206 of the shield 1200 via a fastening arrangement involving the label slot 1230 (FIG. 12).

Although the present disclosure has been described with reference to exemplary embodiments and implementations, it is to be understood that the present disclosure is neither limited by nor restricted to such exemplary embodiments and/or implementations. Rather, the present disclosure is susceptible to various modifications, enhancements and variations without departing from the spirit or scope of the present disclosure. Indeed, the present disclosure expressly encompasses such modifications, enhancements and variations as will be readily apparent to persons skilled in the art from the disclosure herein contained.

The invention claimed is:

1. A connector assembly for electrically connecting each of at least a first pair and a second pair of conductors of a first cable termination to a corresponding one of a first pair and a second pair of conductors of a second cable termination, the first cable termination including a first plug connector defining a corresponding plug body supporting each of at least a first pair and a second pair of electrical contacts for terminating the first pair and second pair of conductors of the first cable termination, and the second cable termination including a second plug connector defining a corresponding plug body supporting each of at least a first pair and a second pair of electrical contacts for terminating the first pair and second pair of conductors of the second cable termination, the connector assembly comprising:

a. a housing defining a first jack opening configured and dimensioned to receive the first plug connector and a second jack opening configured and dimensioned to receive the second plug connector;

b. a first plurality of electrical contacts supported by the housing and positioned in the first jack opening, the electrical contacts of the first plurality being arranged according to a first contact layout geometry and including at least respective first and second pairs of electrical contacts configured and dimensioned to achieve electrical communication with the respective first and second pairs of electrical contacts associated with the first plug connector;

c. a second plurality of electrical contacts supported by the housing and positioned in the second jack opening, the electrical contacts of the second plurality being arranged according to a second contact layer geometry and including at least respective first and second pairs of electrical contacts configured and dimensioned to achieve electrical communication with the respective first and second pairs of electrical contacts associated with the second plug connector; and d. an electrically conductive shield associated with the housing;

wherein the shield includes a shielding extent extending between the first and second jack openings of the housing for establishing a ground continuity across the housing, and for at least partially shielding the housing against an electromagnetic interference;

wherein each electrical contact of the first plurality of electrical contacts is electrically continuous with at least one electrical contact of the second plurality of electrical contacts, and wherein each electrical contact of the second plurality of electrical contacts is electrically continuous with at least one electrical contact of the first plurality of electrical contacts, including wherein the electrical contacts of the first pair of electrical contacts associated with the first plurality of electrical contacts are electrically continuous with the electrical contacts of the first pair of electrical contacts associated with the second plurality of electrical contacts, and the electrical contacts of the second pair of electrical contacts associated with the first plurality of electrical contacts are electrically continuous with the electrical contacts of the second pair of electrical contacts associated with the second plurality of electrical contacts;

wherein at least with respect to the respective first pairs of electrical contacts associated with the first and second pluralities of electrical contacts of the connector assembly, the first contact layout geometry and the second contact layout geometry are the same; and wherein at least with respect to the respective second pairs of electrical contacts associated with the first and second pluralities of electrical contacts of the connector assembly, the first contact layout geometry and the second contact layout geometry are different.

2. A connector assembly according to claim 1, wherein the housing includes respective first and second housing structures joined together to define the housing.

3. A connector assembly according to claim 2, wherein the first and second housing structures are latched with respect to each other.

4. A connector assembly according to claim 1, wherein the first contact layout geometry is an RJ-45 configuration.

5. A connector assembly according to claim 1, wherein the second contact layout geometry corresponds to a configuration defined by the IEC 60603-7-7 standard, including wherein the electrical contacts of one of the first and second pairs of electrical contacts are upwardly deflectable, and are oriented side-by-side with respect to each other in a corresponding upper portion of the second jack opening, and wherein the electrical contacts of the other one of the first and second pairs of electrical contacts are downwardly deflectable, and are oriented side-by-side with respect to each other in a corresponding lower portion of the second jack opening.

6. A connector assembly according to claim 1, further comprising a contact subassembly positioned within the housing.

7. A connector assembly according to claim 6, wherein the contact subassembly supports a plurality of contact support members.

8. A connector assembly according to claim 7, wherein each contact support member includes a pair of electrical contacts.

9. A connector assembly according to claim 6, wherein the contact subassembly supports at least one contact insert.

10. A connector assembly according to claim 6, wherein the contact subassembly includes a printed circuit board.

11. A connector assembly according to claim 10, wherein the printed circuit board is adapted to supply compensation with respect to an electrical connection made with respect to the electrical contacts of the first plurality.

12. A connector assembly according to claim 1, wherein the first and second jack openings are oppositely directed.

13. A connector assembly according to claim 1, wherein the housing is mounted with respect to a patch panel assembly.

14. A connector assembly according to claim 1, wherein the shield further includes respective grounding tabs extending to within respective outlines of the first and second jack openings in the housing for forming respective electrical connections with corresponding structure of a mating connector.

15. A patch panel assembly for interconnecting each instance of a plurality of instances of a first cable termination to a respective instance of a corresponding plurality of instances of a second cable termination, each such interconnection being for electrically connecting each of at least a first pair and a second pair of conductors of a corresponding instance of the first cable termination to a corresponding one of a first pair and a second pair of conductors of a corresponding instance of the second cable termination, the corresponding instance of the first cable termination including a first plug connector defining a corresponding plug body supporting each of at least a first pair and a second pair of electrical contacts for terminating the first pair and second pair of conductors of the first cable termination, and the corresponding instance of the second cable termination including a second plug connector defining a corresponding plug body supporting each of at least a first pair and a second pair of electrical contacts for terminating the first pair and second pair of conductors of the second cable termination, the patch panel assembly, comprising:

a. a housing defining a plurality of instances of a first jack opening configured and dimensioned to receive a corresponding instance of the first plug connector, and a plurality of instances of a second jack opening configured and dimensioned to receive a corresponding instance of the second plug connector;

b. a plurality of instances of a first plurality of electrical contacts supported by the housing, each instance of a first plurality of electrical contacts being positioned in a corresponding instance of the first jack opening, the electrical contacts of each instance of a first plurality of electrical contacts arranged according to a first contact layout geometry, and including at least respective first and second pairs of electrical contacts configured and dimensioned to achieve electrical communication with the respective first and second pairs of electrical contacts associated with corresponding instance of the first plug connector;

c. a plurality of instances of a second plurality of electrical contacts supported by the housing, each instance of a second plurality of electrical contacts being positioned in a corresponding instance of the second jack opening, the electrical contacts of each instance of a second plurality of electrical contacts being arranged according to a second contact layout geometry and including at least respective first and second pairs of electrical contacts configured and dimensioned to achieve electrical communication with the respective first and second pairs of electrical contacts associated with the corresponding instance of the second plug connector; and d. an electrically conductive shield associated with the housing;

wherein the shield includes a shielding extent extending between the first and second jack openings of the housing for establishing a ground continuity across the housing, and for at least partially shielding the housing against an electromagnetic interference;

wherein each electrical contact of the first plurality of electrical contacts is electrically continuous with at least one electrical contact of the second plurality of electrical contacts, and wherein each electrical contact of the second plurality of electrical contacts is electrically continuous with at least one electrical contact of the first plurality of electrical contacts, including wherein the electrical contacts of the first pair of electrical contacts associated with each instance of the first plurality of electrical contacts are electrically continuous with the electrical contacts of the first pair of electrical contacts associated with a corresponding instance of the second plurality of electrical contacts, and the electrical contacts of the second pair of electrical contacts associated with each instance of the first plurality of electrical contacts are electrically continuous with the electrical contacts of the second pair of electrical contacts associated with a corresponding instance of the second plurality of electrical contacts;

wherein at least with respect to the respective first pairs of electrical contacts associated with the respective pluralities of instances of the first and corresponding second pluralities of electrical contacts of the patch panel assembly, the first contact layout geometry and the second contact layout geometry are the same; and wherein at least with respect to the respective second pairs of electrical contacts associated with the respective pluralities of instances of the first and corresponding second pluralities of electrical contacts of the of the patch panel assembly, the first contact layout geometry and the second contact layout geometry are different.

16. A patch panel assembly according to claim 15, wherein the shield further includes respective grounding tabs extending to within respective outlines of the first and second jack openings in the housing for forming respective electrical connections with corresponding structure of a mating connector.

17. In combination:

a. a connector assembly for electrically connecting each of at least a first pair and a second pair of conductors of a first cable termination to a corresponding one of a first pair and a second pair of conductors of a second cable termination, the first cable termination including a first plug connector defining a corresponding plug body supporting each of at least a first pair and a second pair of electrical contacts for terminating the first pair and second pair of conductors of the first cable termination, and the second cable termination including a second plug connector defining a corresponding plug body supporting each of at least a first pair and a second pair of electrical contacts for terminating the first pair and second pair of conductors of the second cable termination, the connector assembly including (i) a housing defining a first jack opening configured and dimensioned to receive the first plug connector and a second jack opening configured and dimensioned to receive the second plug connector, (ii) a first plurality of electrical contacts supported by the housing and positioned in the first jack opening, the electrical contacts of the first plurality being arranged according to a first contact layout geometry and including at least respective first and second pairs of electrical contacts configured and dimensioned to achieve electrical communication with the respective first and second pairs of electrical contacts associated with the first plug connector, (iii) a second plurality of electrical contacts supported by the housing and positioned in the second jack opening, the electrical contacts of the second plurality being arranged according to a second contact layout geometry and including at least respective first and second pairs of electrical contacts configured and dimensioned to achieve electrical communication with the respective first and second pairs of electrical contacts associated with the second plug connector, and (iv) an electrically conductive shield associated with the housing, wherein the shield includes a shielding extent extending between the first and second jack openings of the housing for establishing a ground continuity across the housing, and for at least partially shielding the housing against an electromagnetic interference; and b. a preterminated cable assembly that includes (i) a cable that includes a plurality of shielded or unshielded twisted pair wires; (ii) a plug mounted with respect to the cable; wherein the shielded or unshielded twisted pair wires are arranged in a geometric orientation that corresponds to a configuration defined by the IEC 60603-7-7 standard; and (iii) an electrically conductive shield associated with a housing of the plug;

wherein each electrical contact of the first plurality of electrical contacts is electrically continuous with at least one electrical contact of the second plurality of electrical contacts, and wherein each electrical contact of the second plurality of electrical contacts is electrically continuous with at least one electrical contact of the first plurality of electrical contacts, including wherein the electrical contacts of the first pair of electrical contacts associated with the first plurality of electrical contacts are electrically continuous with the electrical contacts of the first pair of electrical contacts associated with the second plurality of electrical contacts, and the electrical contacts of the second pair of electrical contacts associated with the first plurality of electrical contacts are electrically continuous with the electrical contacts of the second pair of electrical contacts associated with the second plurality of electrical contacts;

wherein the plug of the preterminated cable assembly is inserted into one of the first and second jack openings of the connector assembly to make electrical connection therewith;

wherein at least with respect to the respective first pairs of electrical contacts associated with the first and second pluralities of electrical contacts, the first contact layout geometry and the second contact layout geometry are the same; and wherein at least with respect to the respective second pairs of electrical contacts associated with the first and second pluralities of electrical contacts, the first contact layout geometry and the second contact layout geometry are different; and wherein the shield associated with the housing of the connector assembly forms an electrical connections with corresponding structure of the preterminated cable assembly for establishing a grounding connection therewith.

18. A combination in accordance with claim 17, wherein the shield associated with the housing of the connector assembly further includes a grounding tab extending to within the outline of the one of the first and second jack openings for establishing the grounding connection with the corresponding structure of the preterminated cable assembly.

19. A connector assembly according to claim 1, wherein each of the first plurality of electrical contacts and the second plurality of electrical contacts includes additional respective third and second pairs of electrical contacts configured and dimensioned to achieve electrical communication with additional corresponding respective third and fourth pairs of electrical contacts associated with the first and second plug connectors, and wherein with respect to the respective first and third pairs of electrical contacts associated with the first and second pluralities of electrical contacts of the connector assembly, the first contact layout geometry and the second contact layout geometry are the same, and wherein with respect to the respective second and fourth pairs of electrical contacts associated with the first and second pluralities of electrical contacts of the connector assembly, the first contact layout geometry and the second contact layout geometry are different.

20. A patch panel assembly according to claim 15, wherein each of the first plurality of electrical contacts and the second plurality of electrical contacts includes additional respective third and second pairs of electrical contacts configured and dimensioned to achieve electrical communication with additional corresponding respective third and fourth pairs of electrical contacts associated with the first and second plug connectors, and wherein with respect to the respective first and third pairs of electrical contacts associated with the first and second pluralities of electrical contacts of the connector assembly, the first contact layout geometry and the second contact layout geometry are the same, and wherein with respect to the respective second and fourth pairs of electrical contacts associated with the first and second pluralities of electrical contacts of the connector assembly, the first contact layout geometry and the second contact layout geometry are different.

* * * * *